US008393872B2

(12) United States Patent
Kirtley

(10) Patent No.: US 8,393,872 B2
(45) Date of Patent: Mar. 12, 2013

(54) TURBINE AIRFOIL

(75) Inventor: Kevin Richard Kirtley, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1029 days.

(21) Appl. No.: 12/605,054

(22) Filed: Oct. 23, 2009

(65) Prior Publication Data

US 2011/0097210 A1 Apr. 28, 2011

(51) Int. Cl.
*F03B 3/12* (2006.01)

(52) U.S. Cl. ..... 416/243; 416/242; 416/DIG. 5

(58) Field of Classification Search ..... 416/235, 416/243, 242, DIG. 5
See application file for complete search history.

(56) References Cited

U.S. PATENT DOCUMENTS 686,211 A * 11/1901 Dowson ..... 416/207
5,397,215 A 3/1995 Spear et al.
5,466,123 A 11/1995 Rose
6,283,713 B1 9/2001 Harvey et al.
6,338,609 B1 1/2002 Decker et al.
6,358,012 B1 3/2002 Staubach
6,837,679 B2 1/2005 Kawarada et al.
7,134,842 B2 11/2006 Tam et al.
7,220,100 B2 5/2007 Lee et al.
2005/0249600 A1 11/2005 Kakishita et al.
2008/0118362 A1 5/2008 Hu et al.

FOREIGN PATENT DOCUMENTS

EP 2055893 A1 5/2009

* cited by examiner

*Primary Examiner* — Dwayne J White
(74) *Attorney, Agent, or Firm* — Cantor Colburn LLP

(57) ABSTRACT

An airfoil is provided and includes a pressure surface and a suction surface. Radially corresponding surface characteristics of the pressure and suction surfaces at a spanwise local portion of the airfoil are formed to cooperatively define at least one of a camber line and a thickness distribution plot of the airfoil as having a radius of curvature with at least two sign changes. The number of sign changes decreases along a radial dimension of the airfoil measured from the spanwise local portion.

20 Claims, 4 Drawing Sheets

TURBINE AIRFOIL

BACKGROUND OF THE INVENTION

The subject matter disclosed herein relates to turbine airfoil design.

Traditional turbine blade designs use an arcuate camber line whose radius of curvature varies continuously from leading edge to trailing edge but is always of one sign such that it is purely concave. Further, the thickness distribution along the camber line for traditional gas turbine blades is also arcuate with a radius of curvature that varies continuously from leading edge to trailing edge but is always of one sign such that it is also purely concave. Such configurations lead to energy extraction and relatively efficient flow through the turbine when gas flow is two dimensional in the plane defined by the camber line in a cylindrical polar coordinate frame.

The flow has often been observed to be substantially three dimensional and out of plane and, in these cases, the pure concavity of turbine blades can be less efficient than the two dimensional case. Thus, the desire for increased turbine blade efficiency where the flow is three dimensional has driven traditional airfoil shapes toward thin trailing edges, customized camber lines for aft loading and spanwise leaning and bowing to impose radial pressure gradients to modulate the distribution of flow through the passage.

Often, however, mechanical constraints limit trailing edge thinness and the rotation of blades requires the use of radial blade elements to avoid high bending loads during rotation, which precludes aggressive bowing and leaning. In view of these outcomes, endwall contouring with bumps and gouges within the blade passage and extensions up and downstream have been described to modulate the secondary flow development in the neighborhood of the blade root endwall. Unfortunately, endwall contouring can lead to manufacturing and implementation challenges like casting the gouges or the need for a wavy under platform friction damper for rotor blades.

BRIEF DESCRIPTION OF THE INVENTION

According to one aspect of the invention, an airfoil for extracting energy in a turbine engine is provided and includes a pressure surface and a suction surface, radially corresponding surface characteristics of the pressure and suction surfaces at a spanwise local portion of the airfoil being formed to cooperatively define a camber line of the airfoil as having a radius of curvature with at least two sign changes, the number of sign changes decreasing along a radial dimension of the airfoil measured from the spanwise local portion.

According to another aspect of the invention, an airfoil for extracting energy in a turbine engine is provided and includes a pressure surface and a suction surface, radially corresponding surface characteristics of the pressure and suction surfaces at a spanwise local portion of the airfoil being formed to cooperatively define a thickness distribution plot of the airfoil as having a radius of curvature with at least two sign changes, the number of sign changes decreasing along a radial dimension of the airfoil measured from the spanwise local portion.

According to yet another aspect of the invention, an airfoil for extracting energy in a turbine engine is provided and includes a pressure surface having pressure surface characteristics and a suction surface having suction surface characteristics, the pressure and suction surface characteristics being formed at a spanwise local portion of the airfoil to cooperatively define at least one of a camber line of the airfoil and a thickness distribution plot of the airfoil as having a radius of curvature with at least two sign changes, the number of sign changes decreasing to zero along a radial dimension of the airfoil measured from the spanwise local portion.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features without limitation, by way of example with reference to the drawings.

DETAILED DESCRIPTION OF THE INVENTION

Figure 1:
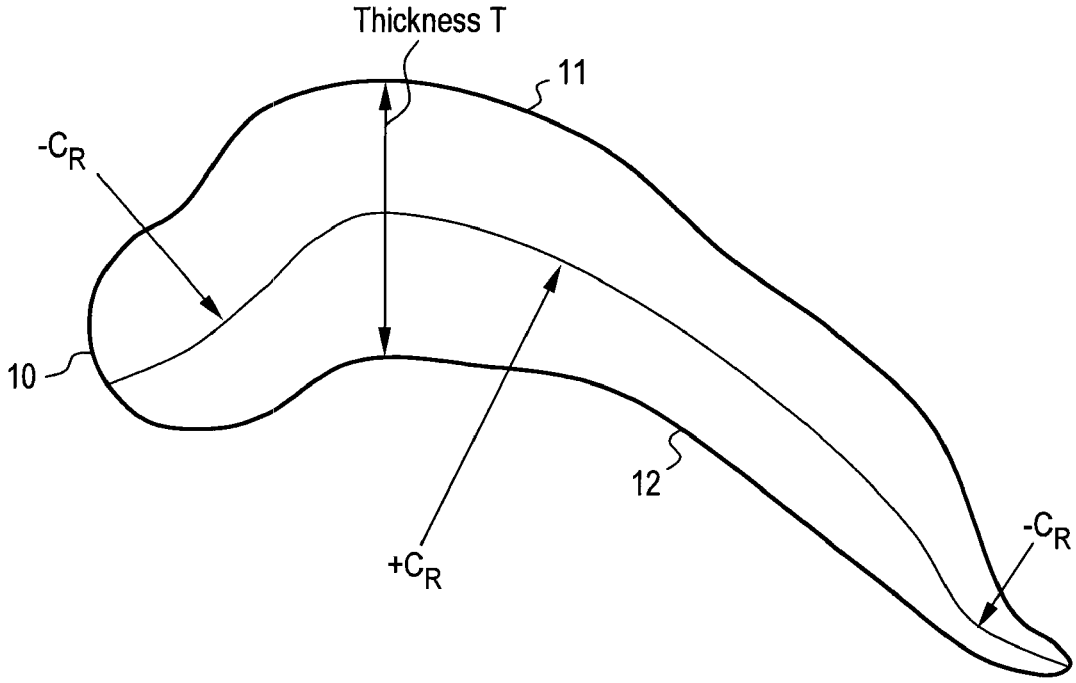
FIG. 1 is a radial view of an airfoil.
Figure 2:
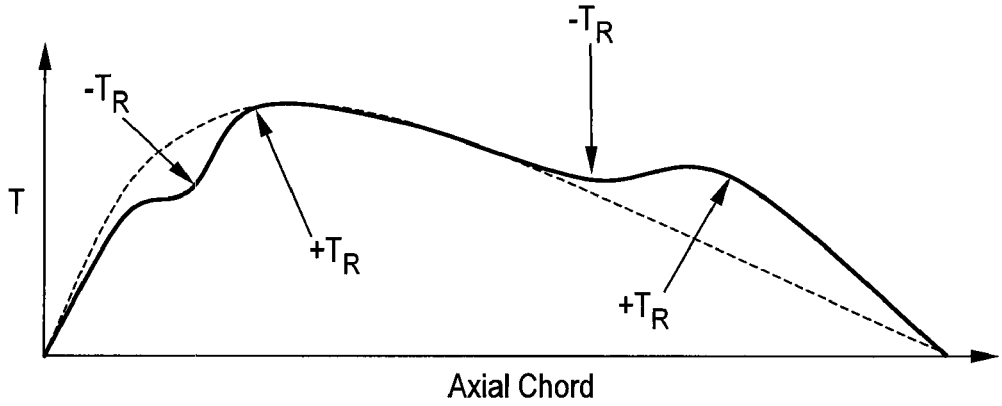
FIG. 2 is a graph of a thickness variation plot of the airfoil of FIG. 1.

With reference to FIGS. 1 and 2, an airfoil 10 for extracting energy in a turbine engine is provided and includes a suction surface 11 and a pressure surface 12. The suction surface 11 and the pressure surface 12 each have radially corresponding surface characteristics at a spanwise local portion of the airfoil 10 that cooperatively define at least one of a camber line $C_R$ and/or a thickness distribution plot $T_R$ relative to an axial chord of the airfoil 10 as having a radius of curvature with at least two sign changes. The number of sign changes decreases along a radial dimension of the airfoil 10 measured from the spanwise local portion. In some cases, the number of sign changes decreases to zero.

The convexity and concavity of the camber line $C_R$ and/or the thickness distribution $T_R$ will be generally located within about 10% of the airfoil 10 span near its root for an airfoil 10 that has an endwall at only the root. The same is oppositely true for those airfoils having endwalls at their tip. For those airfoils that have endwalls at both their root and tip, the convexity and concavity can be implemented within 10% span of each endwall. In some cases (see FIG. 9 for example), the convexity and concavity of the camber line $C_R$ and/or the thickness distribution $T_R$ may extend beyond the ranges described above.

Figure 3:
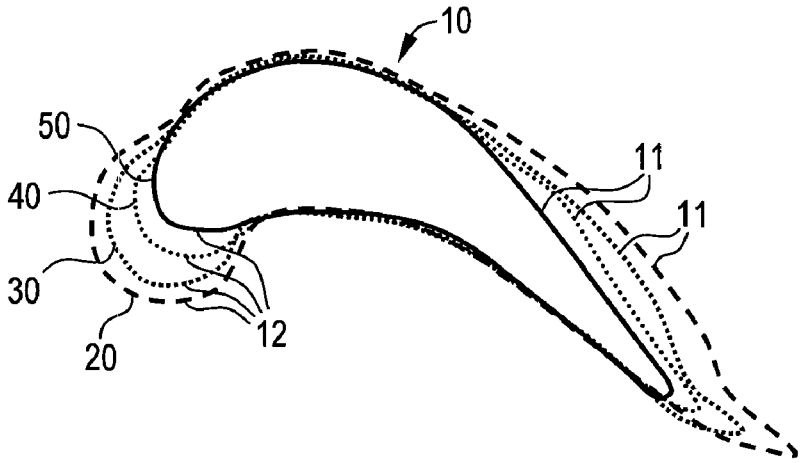
FIG. 3 is a schematic 3-dimensional radial view of an airfoil.
Figure 4:
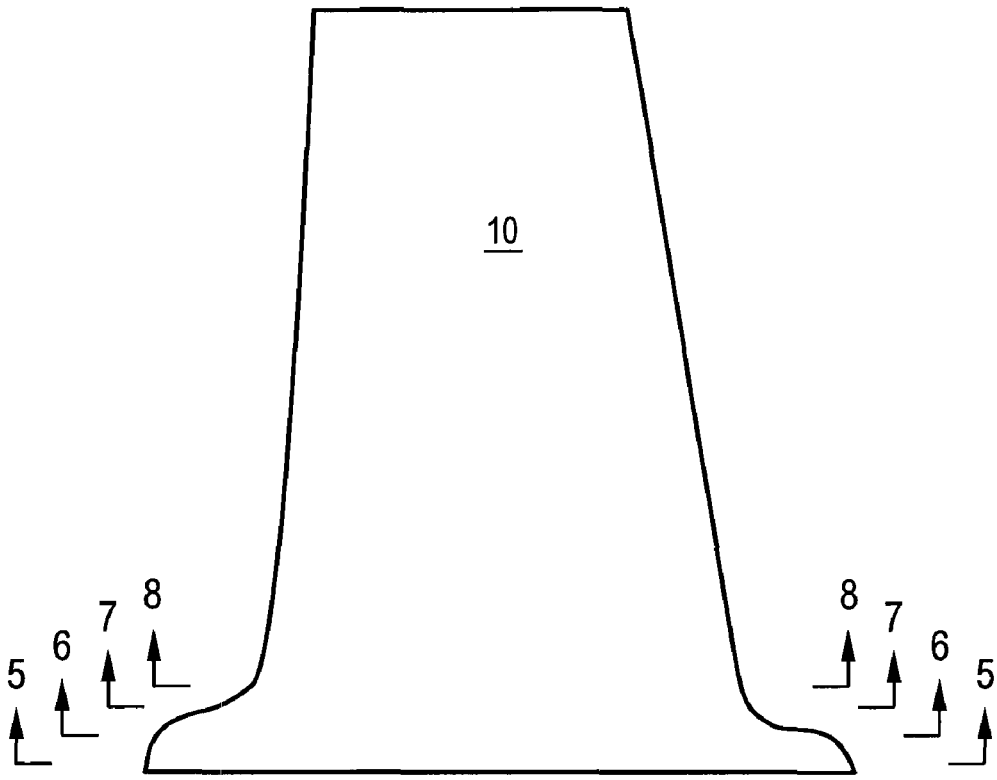
FIG. 4 is a perimetric view of the airfoil of FIG. 3.

With reference to FIG. 3, the airfoil 10 having a camber line $C_R$ and/or a thickness distribution $T_R$ that is both convex and concave may include varying surface characteristics at increasing radial positions. In an embodiment, the airfoil 10 has at least first, second, third and fourth topographies 20, 30, 40 and 50, respectively, along a radial dimension of the airfoil 10. As shown in FIGS. 4-8, these topographies correspond to lines 5-5 (topography 20, shown in FIG. 5), 6-6 (topography 30, shown in FIG. 6), 7-7 (topography 40, shown in FIG. 7) and 8-8 (topography 50, shown in FIG. 8), respectively, which each cut through the perimetric view of the span and the chord airfoil 10 of FIG. 4.

Figure 5:
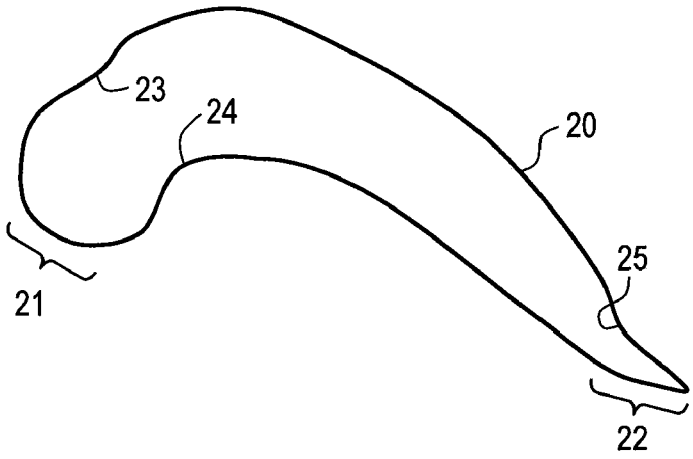
FIGS. 5-8 are radial views of the airfoil of FIG. 5 at increasing radial positions.

In an exemplary embodiment, as shown in FIG. 5, at the spanwise local portion of the airfoil 10 corresponding to topography 20, the surface characteristics of the suction surface 11 and the pressure surface 12 form a relatively irregular nose section 21 and a relatively irregular tail section 22 proximate to leading and trailing edges of the airfoil 10, respectively. That is, the nose section 21 at the spanwise local portion of the airfoil 10 corresponding to topography 20 is characterized with opposing recessed regions 23 and 24 at its throat while the tail section 22 is characterized by a single recessed region 25.

Figure 6:
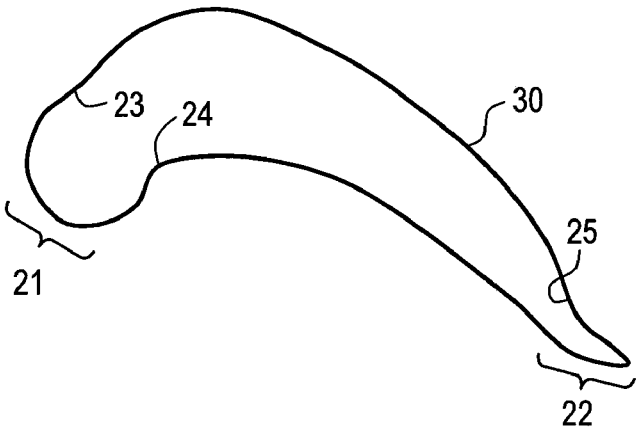
Figure 7:
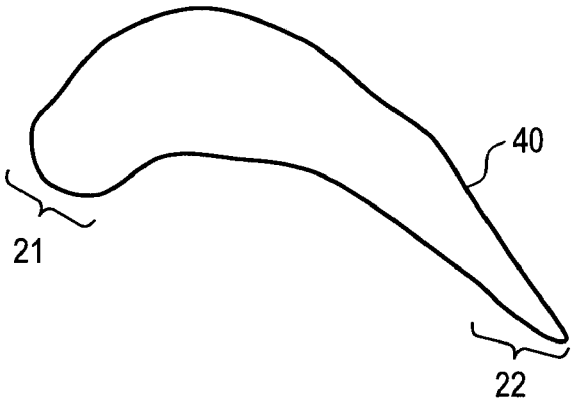
Figure 8:
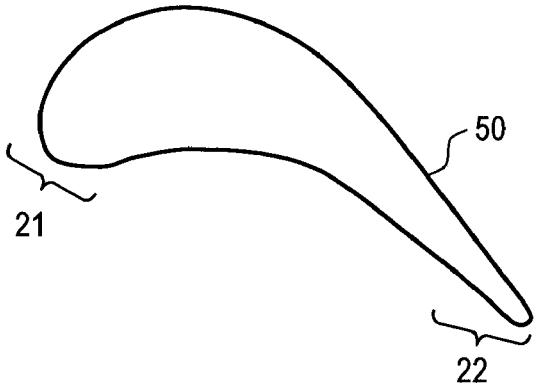

As sequentially shown in FIGS. 6-8, the spanwise portions of the airfoil 10 corresponding to topographies 30, 40 and 50 of the airfoil 10 have features that become decreasingly prominent as one proceeds further along the radial dimension of the airfoil 10. For instance, the respective shapes of the nose section 21 and the tail section 22 become increasingly smooth. That is, the nose section 21 may be relatively bulbous at a radial position of the airfoil 10 and become decreasingly bulbous along a radial dimension of the airfoil 10. Similarly, the tail section 22 may be curved in a direction of turbine stage rotation at a radial position of the airfoil 10 with the curve decreasing and/or eventually reversing in direction along a radial dimension of the airfoil 10. Eventually, as shown in FIG. 8, the number of sign changes may decrease to zero along a radial dimension of the airfoil 10 measured from the spanwise local portion corresponding to topography 20. In this way, the spanwise portion of the airfoil 10 corresponding to topography 50 resembles a relatively common airfoil shape.

While FIGS. 4-8 cooperatively illustrate the number of sign changes of at least one of the camber line $C_R$ and/or the thickness distribution plot $T_R$ decreasing to zero, it is understood that this merely reflects exemplary embodiments and that other formations may be employed. For example, in some cases, the number of sign changes may only decrease to 1 or more. In other cases, some topographic features at a particular chordal location of an airfoil may become decreasingly prominent along a radial dimension of the airfoil without causing the camber line $C_R$ or the thickness distribution plot $T_R$ of the airfoil at that particular chordal location to change sign.

Figure 9:
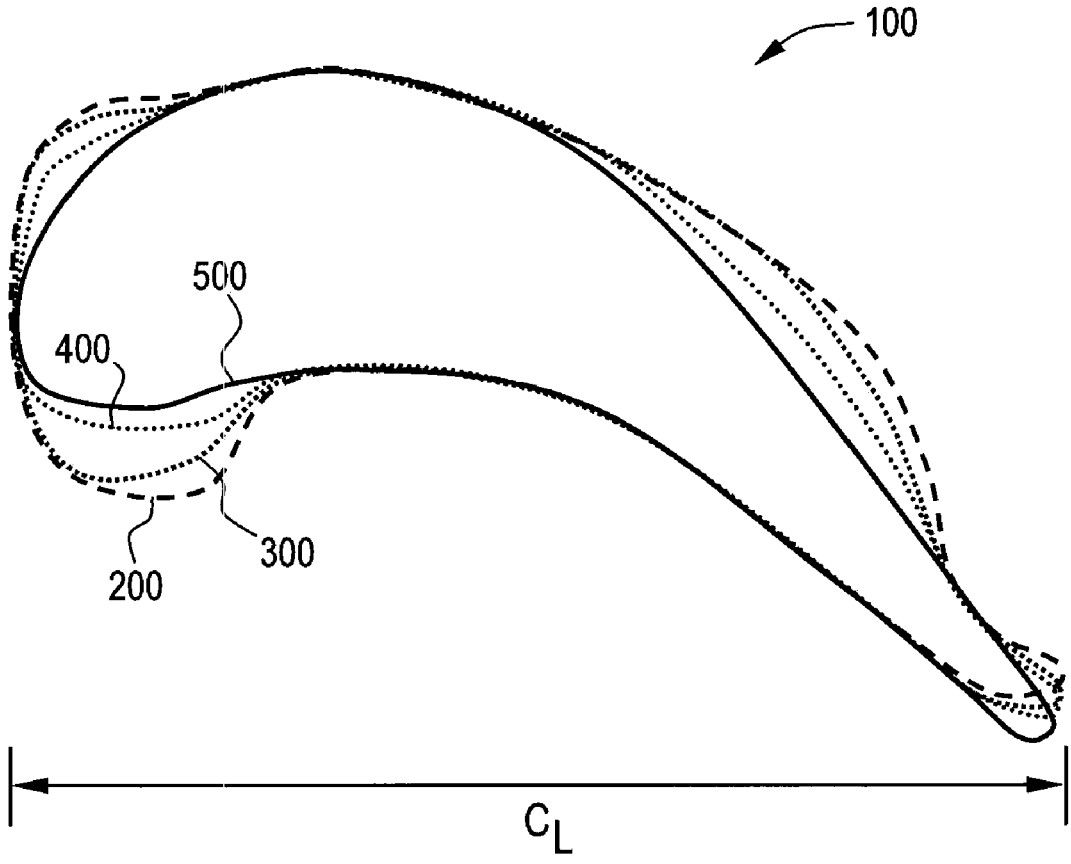
FIG. 9 is a schematic 3-dimensional radial view of an airfoil.

As shown in FIG. 9, a second airfoil 100 according to another embodiment may have a chord length $C_L$ that is substantially uniform at two or more radial (or spanwise) positions at which the surface characteristics cooperatively define at least one of the camber line $C_R$ and/or the thickness distribution $T_R$ as having a radius of curvature with at least two sign changes. In this case, the convexity and concavity of the camber line $C_R$ and/or the thickness distribution $T_R$ of the airfoil 100 extend beyond the ranges described above. As such, the additional topographies 200, 300, 400 and 500, which are not necessarily proximate to either the root or the tip, become decreasingly prominent as one proceeds further along the radial dimension.

In accordance with further aspects, a method of forming a pressure and a suction surface of an airfoil is provided and includes analyzing a three dimensional flowpath of fluid flowing over the airfoil and designing radially corresponding surface characteristics of the pressure and suction surfaces at a spanwise local portion of the airfoil to cooperatively define at least one of a camber line and a thickness distribution plot of the airfoil as having a radius of curvature with at least two sign changes in accordance with the analysis. The method may further include designing the surface characteristics to cooperatively define the other of the camber line and the thickness distribution plot as having a radius of curvature with at least two sign changes in accordance with the analysis.

In accordance with the method, the designing may further include changing the surface characteristics along a radial dimension of the airfoil measured from the spanwise local portion such that the number of sign changes decreases. In some cases, these changes will result in the number of sign changes decreasing to one or more sign changes. In other cases, the changes will result in the number of sign changes decreasing all the way to zero.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An airfoil for extracting energy in a turbine engine, comprising:

a pressure surface; and a suction surface, radially corresponding surface characteristics of the pressure and suction surfaces at a spanwise local portion of the airfoil being formed to cooperatively define a camber line of the airfoil as having a radius of curvature with at least two sign changes, the number of sign changes decreasing along a radial dimension of the airfoil measured from the spanwise local portion.

2. The airfoil according to claim 1, wherein the surface characteristics form an irregular nose section proximate to a leading edge of the airfoil.

3. The airfoil according to claim 2, wherein features of the irregular nose section become decreasingly prominent along a radial dimension of the airfoil.

4. The airfoil according to claim 2, wherein the irregular nose section is bulbous at a radial position of the airfoil and becomes decreasingly bulbous along a radial dimension of the airfoil.

5. The airfoil according to claim 1, wherein the surface characteristics form a tail section proximate to a trailing edge of the airfoil.

6. The airfoil according to claim 5, wherein features of the tail section become decreasingly prominent along a radial dimension of the airfoil.

7. The airfoil according to claim 5, wherein the tail section curves in a direction of turbine stage rotation at a radial position of the airfoil with an amount of curvature decreasing along a radial dimension of the airfoil.

8. The airfoil according to claim 1, wherein the surface characteristics cooperatively define a thickness distribution plot of the airfoil as having a radius of curvature with at least two sign changes.

9. The airfoil according to claim 1, wherein a chord length of the airfoil is substantially uniform at two or more radial positions at which the surface characteristics cooperatively define the camber line as having a radius of curvature with at least two sign changes.

10. An airfoil for extracting energy in a turbine engine, comprising:

a pressure surface; and a suction surface, radially corresponding surface characteristics of the pressure and suction surfaces at a spanwise local portion of the airfoil being formed to cooperatively define a thickness distribution plot of the airfoil as having a radius of curvature with at least two sign changes, the number of sign changes decreasing along a radial dimension of the airfoil measured from the spanwise local portion.

11. The airfoil according to claim 10, wherein the surface characteristics form an irregular nose section proximate to a leading edge of the airfoil.

12. The airfoil according to claim 11, wherein features of the irregular nose section become decreasingly prominent along a radial dimension of the airfoil.

13. The airfoil according to claim 11, wherein the irregular nose section is bulbous at a radial position of the airfoil and becomes decreasingly bulbous along a radial dimension of the airfoil.

14. The airfoil according to claim 11, wherein the surface characteristics form a tail section proximate to a trailing edge of the airfoil.

15. The airfoil according to claim 14, wherein features of the tail section become decreasingly prominent along a radial dimension of the airfoil.

16. The airfoil according to claim 14, wherein the tail section curves in a direction of turbine stage rotation at a radial position of the airfoil with an amount of curvature decreasing along a radial dimension of the airfoil.

17. The airfoil according to claim 10, wherein the surface characteristics cooperatively define a camber line having a radius of curvature with at least two sign changes.

18. The airfoil according to claim 10, wherein a chord length of the airfoil is substantially uniform at two or more radial positions at which the radially corresponding surface characteristics cooperatively define the thickness distribution plot as having a radius of curvature with at least two sign changes.

19. An airfoil for extracting energy in a turbine engine, comprising:

a pressure surface having pressure surface characteristics; and a suction surface having suction surface characteristics, the pressure and suction surface characteristics being formed at a spanwise local portion of the airfoil to cooperatively define at least one of a camber line of the airfoil and a thickness distribution plot of the airfoil as having a radius of curvature with at least two sign changes, the number of sign changes decreasing to zero along a radial dimension of the airfoil measured from the spanwise local portion.

20. The airfoil according to claim 19, wherein a chord length of the airfoil is substantially uniform at the spanwise local portion and at another spanwise portion spaced from the spanwise local portion along the radial dimension.

* * * * *